US011434101B2

(12) United States Patent
Comotto et al.

(10) Patent No.: US 11,434,101 B2
(45) Date of Patent: Sep. 6, 2022

(54) PILOTED ELECTROMAGNETIC BRAKE FOR CONTROLLING THE TENSION OF THE WEFT YARN IN WEAVING MACHINES

(71) Applicant: ROJ S.R.L., Biella (IT)

(72) Inventors: Renato Comotto, Biella (IT); Matteo Fazzari, Biella (FR); Paolo Ricci, Biella (FR)

(73) Assignee: ROJ S.R.L., Biella (IT)

( * ) Notice: Subject to any disclaimer, the term of this patent is extended or adjusted under 35 U.S.C. 154(b) by 954 days.

(21) Appl. No.: 15/772,016

(22) PCT Filed: Oct. 14, 2016

(86) PCT No.: PCT/IB2016/056163
§ 371 (c)(1),
(2) Date: Apr. 27, 2018

(87) PCT Pub. No.: WO2017/072622
PCT Pub. Date: May 4, 2017

(65) Prior Publication Data

US 2018/0312367 A1 Nov. 1, 2018

(30) Foreign Application Priority Data

Oct. 30, 2015 (IT) ..... 102015000067244

(51) Int. Cl.
*D03D 47/34* (2006.01)
*B65H 59/22* (2006.01)

(52) U.S. Cl.
CPC ..... *B65H 59/22* (2013.01); *D03D 47/347* (2013.01); *B65H 2701/31* (2013.01)

(58) Field of Classification Search
CPC ... B65H 59/22; B65H 2701/31; D03D 47/347
See application file for complete search history.

(56) References Cited

U.S. PATENT DOCUMENTS 5,398,731 A * 3/1995 Schuster ..... B65H 59/22 139/194
5,398,732 A * 3/1995 Zenoni ..... B65H 59/22 139/194

(Continued)

FOREIGN PATENT DOCUMENTS

FR 1 161 662 A 8/1958

OTHER PUBLICATIONS

International Search Report, dated Feb. 1, 2017, from corresponding PCT/IB2016/056163 application.

*Primary Examiner* — Katharine G Kane
(74) *Attorney, Agent, or Firm* — Nixon & Vanderhye

(57) ABSTRACT

Piloted electromagnetic brake for controlling the tension of the weft threads in weaving machines, in particular of a weft thread which has a high number of knots, of the type including a pair of opposite elastic thin plates between which the weft thread runs, an operated thin plate being adjusted in position by an electromagnetically controlled operating piston, and a resisting thin plate being resistant against an elastic contrast unit, in order to control the intensity of the contrast force between the pair of thin plates. The resisting thin plate and the operated thin plate have fulcrum points in correspondence of a central portion thereof, so as to be able to freely oscillate in a plane containing the weft thread, during the passage of a knot between them, and the fulcrum points are offset by a set length along the weft thread running direction.

15 Claims, 3 Drawing Sheets

(56) References Cited

U.S. PATENT DOCUMENTS

| | | | | | |
|---|---|---|---|---|---|
| 5,483,997 | A * | 1/1996 | Corain | B65H 59/22 | 139/194 |
| 5,725,029 | A * | 3/1998 | Loehr | D03D 47/34 | 139/194 |
| 6,161,595 | A * | 12/2000 | Shaw | B65H 59/22 | 188/65.1 |
| 6,467,512 | B1 * | 10/2002 | Meyer | D03D 51/34 | 139/435.2 |
| 6,810,918 | B2 * | 11/2004 | Birner | B65H 59/18 | 139/194 |
| 7,073,399 | B2 * | 7/2006 | Josefsson | D03D 47/34 | 139/194 |
| 7,077,168 | B2 * | 7/2006 | Herrlein | B65H 59/24 | 139/194 |
| 2001/0022201 | A1 * | 9/2001 | Loehr | B65H 59/22 | 139/194 |

* cited by examiner

PILOTED ELECTROMAGNETIC BRAKE FOR CONTROLLING THE TENSION OF THE WEFT YARN IN WEAVING MACHINES

The present invention refers to a piloted electromagnetic brake for controlling the tension of the weft threads in weaving machines. The invention particularly refers to a brake of this type having improved features for controlling the tension of the weft threads having a high number of knots.

FIELD OF THE INVENTION

Positively operated electromagnetic brakes are known since long in the field of weaving machines, every time there is a need to modulate the tension level of the weft thread during its insertion. This type of brake is characterized by the presence of two opposing elastic elements, usually formed by metallic shape-resilient thin plates, at least one of them being mobile and whose action can be modified depending on the position of an electromagnetically controlled operating piston, in order to control the intensity of the contrast force between the two elements. Using this type of brake it is thus possible to modulate the braking effect on the weft thread which runs between the two elastic elements and therefore its tension, as desired.

In weaving looms, to which the electromagnetic brake of the present invention is primarily addressed, this type of brake is typically used to increase the weft thread tension in critical steps of weft thread insertion during which a major control on the thread is needed, as it typically happens in the weft thread interchange phase between a carrying gripper and a drawing gripper, or during the final phase when the weft thread reaches the shed outlet.

BACKGROUND OF THE PRIOR ART

In the general technical field of electromagnetic brakes for weft threads described above, a particular problem concerns the processing of weft threads which are characterised by a high number of knots, as it happens for example in jute manufacturing. The presence of knots creates indeed discontinuity points in the braking action on the thread, since the thin plate support devices cannot quickly shift when the knot is passing, due to their high inertia, thus leading in this phase to a sudden rising spike in the tension of the weft thread which is consequently irregularly stressed and can even break. As a consequence, it is actually found that threads which have a high number of knots show higher frequency in thread breaking than those which have few knots or none.

Moreover, even when the knot passes through the brake without causing the weft thread breaking, the possibilities to accurately control the thread tension are suddenly impaired. In fact, while the knot goes through the brake it causes an obvious spacing of the opposed brake thin plates due to the greater thickness of the knot itself, compared to the thread; therefore when the knot has overcome the point of contact between the elastic thin plates a certain time is needed before said thin plates recover their standard contact position. Although this gap is short in absolute terms—typically in the range of some hundredths of second—during this period a condition of complete absence of control on the thread tension takes place, which condition is sufficient to produce textile inconveniences.

This problem has been specifically addressed by EP-2349896 to Picanol, which provides to this purpose an electromagnetic brake in which one of the two elastic elements of the brake, precisely the one which is not activated by the operating piston, consists of an elongated flexible thin foil, supported by a spring system along its overall length and having therefore many points of contact with the same, in order to define correspondent points of closer contact between the two elastic elements of the brake. According to this solution, the overall braking force on the thread is mostly distributed among these many points of closer contact between the elastic elements of the brake, so that when a knot comes to one of these points of contact it undergoes a contrasting force which is only a fraction of the overall braking force, and consequently also the rising spike in the weft thread tension is correspondingly decreased. Moreover, the presence of said many points of contact between the spring system and the elastic element of the brake supported by said spring system allows to maintain a more continuous braking action also while the knot is passing through the electromagnetic brake, since the spacing between the two elastic elements of the brake, which is determined by the passage of the knot in a point of contact between one of said elastic elements and the spring system, does not interfere with the position of the other points of contact of the spring system, which than can carry on their contrast action between the two elastic elements of the brake.

The Picanol solution described above represents a significant improvement on the existing prior art situation and it provides therefore a first answer to the problem of a proper braking weft threads bearing a high number of knots. However, said solution still shows some drawbacks.

A first drawback consists in the fact that, in order to have a sufficient number of points of contact between the spring system and a flexible element of the brake, this flexible element of the brake needs to have a significantly increased length contact area with the weft thread. So, the abrasive action of the brake on the weft thread is undesirably increased and the overall size of the device is undesirably increased too.

A second drawback comes from the fact that in the above said solution the problem was addressed only in quantitative terms—i.e. by subdividing the negative effect of the tension spike of the weft thread among a larger number of points of contact—without however modifying in each one of the plurality of points of contact of the electromagnetic brake, in terms of quality, the impact mode on the elastic thin plates which arises when a knot is passing, which impact mode, in fact, remained the same as the traditional one.

SUMMARY OF THE INVENTION

The present invention is aimed to provide a new type of piloted electromagnetic brake for controlling the tension of a weft thread, particularly of a weft thread which has a high number of knots, which overcomes the above described drawbacks of presently known brake devices.

In particular, a first object of the present invention is to provide a brake of the type described above, which allows the passage of knots without determining high tension spikes in the weft thread.

Then, a second object of the present invention is that said improved brake allows the passage of the weft thread knots between the brake thin plates, without interrupting the braking action on the weft thread.

Lastly, a third object of the present invention is that said brake does not unduly increase the contact zone on the weft thread, compared to the prior art brakes preceding the above described Picanol solution, in order to avoid any possible wear of the weft thread by abrasion and to show almost the same overall size of the above mentioned known brakes.

These objects are achieved by a piloted electromagnetic brake for controlling the tension of the weft threads in weaving machines, in particular of a weft thread which has a high number of knots, of the type comprising a pair of opposing elastic thin plates between which the weft thread runs, a first thin plate, or operated thin plate, being adjusted in position by an electromagnetically controlled operating piston, and a second thin plate, or resisting thin plate, being resistant in reply to elastic contrast means, in order to control the intensity of the contrast force between said pair of thin plates, characterized in that at least one of said resisting thin plate and said operated thin plate has a fulcrum point in correspondence of a central portion thereof, so as to be able to freely oscillate in a plane containing the weft thread, during the passage of a weft thread knot between said resisting thin plate and said operated thin plate.

According to a preferred feature of the invention, said fulcrum point of at least one between said resisting thin plate and said operated thin plate is moreover offset backward or forward by a set length, along the weft thread running direction, with respect to the central point of contact or to the fulcrum point of the other one between said resisting thin plate and said operated thin plate. Other preferred features of such electromagnetic brake are defined in the dependent claims.

BRIEF DESCRIPTION OF THE DRAWINGS

Further features and advantages of the electromagnetic brake according to the present invention will anyhow be more evident from the following detailed description of a preferred embodiment of the same, given as a mere and non-limiting example and illustrated in the attached drawings, wherein.

DETAILED DESCRIPTION OF THE PREFERRED EMBODIMENT

Figure 1:
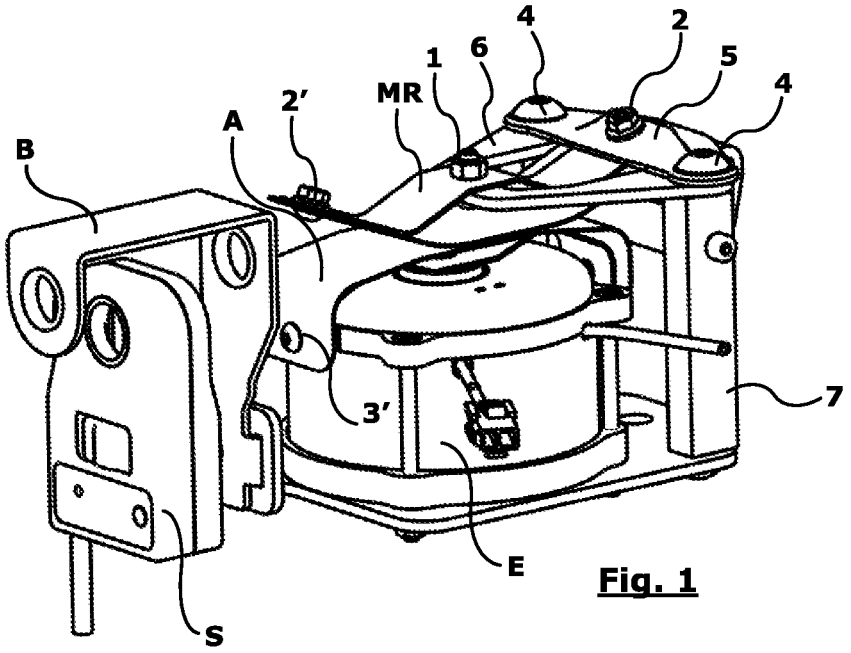
FIG. 1 is a perspective view of a preferred embodiment of the electromagnetic brake according to the present invention.
Figure 2:
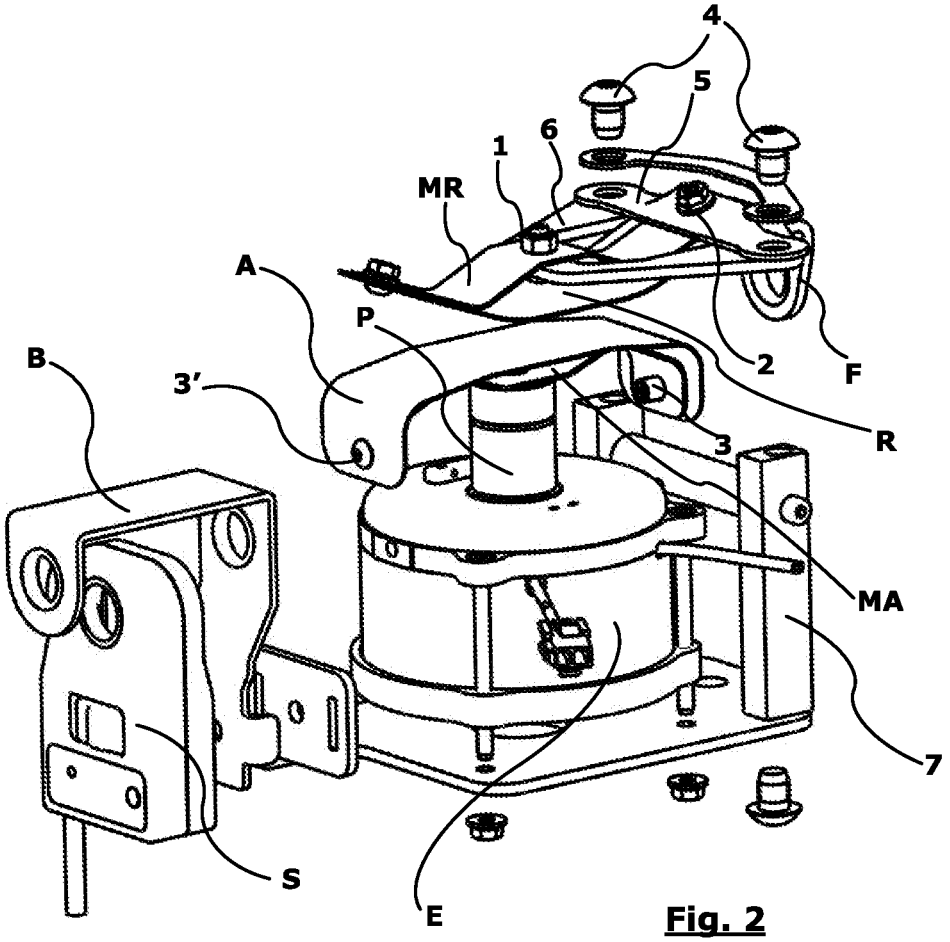
FIG. 2 is a perspective view with some parts exploded of the electromagnetic brake of FIG. 1.
Figure 3:
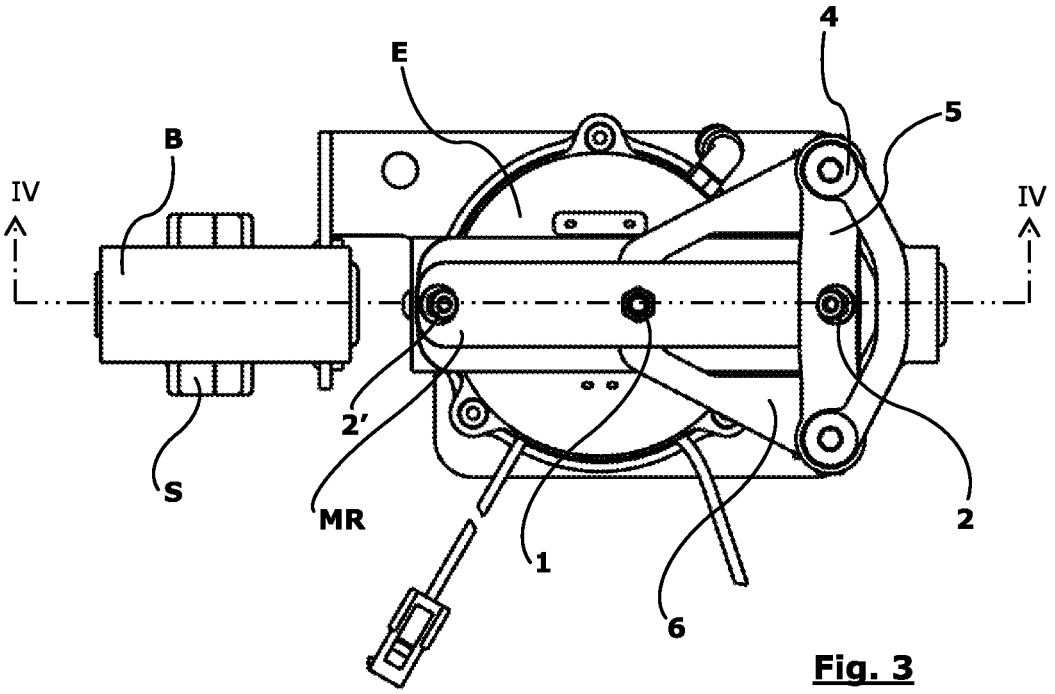
FIG. 3 is a plan view of the electromagnetic brake of FIG. 1.

According to the present invention, in order to overcome the above highlighted drawbacks by means of a compact and easy to build but highly effective solution, it was conceived to radically change the type of mechanical solution that, in known electromagnetic brakes, causes the thin plates spacing which allows the passage of the knot therebetween. In such known brakes, in fact, the thin plates spacing is obtained by means of a movement of the thin plate having lower mass and so a lower inertia—which is normally the thin plate opposite to the one fixed onto the operating piston and which will be briefly addressed in the following as "resisting thin plate"—which elastically moves, shifting in a direction that is substantially perpendicular to the weft thread path, against spring means which elastically push thereon.

According to the studies made by the Applicant, a shift of this type—despite the use of very light thin plates and suitably calibrated contrast spring systems—has anyway a very high inertia and is therefore inherently too slow compared to the speed of progress of the weft thread, so that the passage of the knot between the thin plates inevitably occurs without the desired gradualness and cause unacceptably high tension peaks in the weft thread. Furthermore, as already said above, also the return path of the resisting thin plate into its standard working position—after the passage of the knot—is not fast enough, thus determining a lack of control over the weft thread for an excessively long time.

Facing such impossibility to change the traditional electromagnetic brakes in a satisfactory way in order to allow the processing of threads with a large number of knots, the Applicant had the insight to radically change the constructive solution of the brake itself and to obtain the spacing movement of the thin plates by means of an oscillation of at least one of the brake thin plates around a respective central pivoting fulcrum and not anymore by a translation of the resisting thin plate in a direction perpendicular to the weft thread.

The size and weight of the thin plate being equal, in fact, the rotational inertia connected to an oscillation movement is much lower than the inertia of a translational movement of the entire thin plate and this therefore allows to obtain much higher moving away speeds of the thin plates, following the stress induced by a knot entering in the brake, with respect to those that may be found in conventional brakes, so drastically reducing the impact effect of the knot against the thin plates, and then maintaining the tension of the weft thread within acceptable limits. Furthermore, by providing the brake thin plates with respective pivoting fulcrums, the rotational inertia of each thin plate around its own fulcrum is completely distinguished from the translational inertia that belongs to the same fulcrum thanks to its mechanical connection to a different element of the brake, both if this is the resisting thin plate support structure or the operating piston itself. This allows to use the same construction of a "thin plate floating on a pivoting point" both for the resisting thin plate and for the thin plate mounted on said operating piston P—in the following, for brevity, simply referred to as "operated thin plate"—no more having to worry about the translational inertia values of the operating piston P. Thanks to this particular structure, the electromagnetic brake comprises at least one and preferably two pivoted thin plates.

According to a preferred additional feature of the invention, the two thin plates fulcrums are furthermore offset by a set length along the thread running direction, in order to obtain an electromagnetic brake in which, at the passage of a knot in the weft thread, the two opposing thin plates alternately and consecutively oscillate. To effectively accomplish this effect, such length should be at least 5 mm and preferably greater than 10 mm, while in order to avoid excessively increasing the overall size of the brake, it is preferable that it does not exceed 20 mm. An electromagnetic brake incorporating this additional feature is particularly effective since, in addition to achieving the desired object of a more smooth passage of the knots between the brake thin plates, also allows to achieve another object of the invention, i.e. maintaining a constant braking contact between the operated thin plate and the resisting thin plate.

From what described above it can actually be understood that the point of contact between the thin plates, where the braking action of the weft thread effectively takes place, will take positions respectively opposite to those of entry/exit of the knot where the thin plates move apart thanks to their oscillating movement. The brake control action on the thread is thereby maintained without any interruption during the passage of the knot, and precisely it is maintained downstream of the knot during the entry phase into the brake, on the knot in the intermediate stage, and upstream of the knot during the exit phase, brilliantly solving also this drawback, typical of the traditional electromagnetic brakes. On the basis of these insights it was thus tuned the present invention.

The preferred embodiment of the electromagnetic brake of the present invention illustrated in the drawings, comprises, as standard components entirely similar to those of the traditional brakes, an electromagnet E, a single eyelet thread guide F at the weft thread entry, a two eyelets thread guide B at the weft thread exit and a sensor S sensing the presence of the weft thread placed in between the two eyelets of the exit thread guide B. Still in known manner, the electromagnet E is provided with an axially movable operating piston P for adjusting the position of a first operated thin plate A of the brake by means of a respective spring element MA, also in laminar form, said spring element MA being interposed between the operating piston P head, to which it is fixed in a central position, and the operated thin plate A, to which it is fixed at its opposite ends.

According to the above already recalled main feature of the invention, the elastic thin plates of the brake are mounted so as to be able to freely oscillate about a central pivoting point. To allow a greater elasticity to the thin plates, said pivoting point is formed into laminar spring elements, MR and MA, which respectively elastically support the resistant thin plate R and the operated thin plate A, to which are in fact stably joined at their opposite ends. In particular, the MR spring element is joined in 2 and 2' to the resistant thin plate R, while the spring element MA is joined in 3 and 3' to the operated thin plate A. In addition, the ends of the operated thin plate A and the relative spring element MA are connected to the electromagnet E body by such a constraint as to prevent the thin plate itself to rotate around the operating piston P axis, but also as not to compromise the above described tilting movement of the thin plate itself in a plane containing the weft thread and the thin plate ends.

The resistant thin plate is hinged at 1, via the respective spring element MR, to a triangular hollow bracket 6 projecting from a vertical supporting fork 7 which is integral with the electromagnetic brake frame. The thin plate A is hinged in the axial position, via the respective spring element MA, onto the operating piston P head. Thanks to this arrangement, at any time they are stressed by the action of a weft thread knot entering the brake, the resistant thin plate R and the operated thin plate A can oscillate, in a plane containing the weft thread and the ends of said thin plates, about the respective fulcrums, freely moving and being elastically recalled to the rest position illustrated in the drawings by the action of the spring elements MR, MA.

As already said in the introductory part of the present specification, the thin plates oscillation inertia is much lower than their translational inertia, so that the shifting of the thin plates of the brake of the present invention under the action of an entering knot is much faster than in traditional brakes. Furthermore, the thin plates oscillation has the effect of increasing the distance between the braking thin plates much more quickly compared to what happens in known brakes only using a translational thin plate shifting; the entry of the knot between the two thin plates is therefore extraordinarily eased also in the case of bulky knots, as it happens for example in jute processing.

Figure 4:
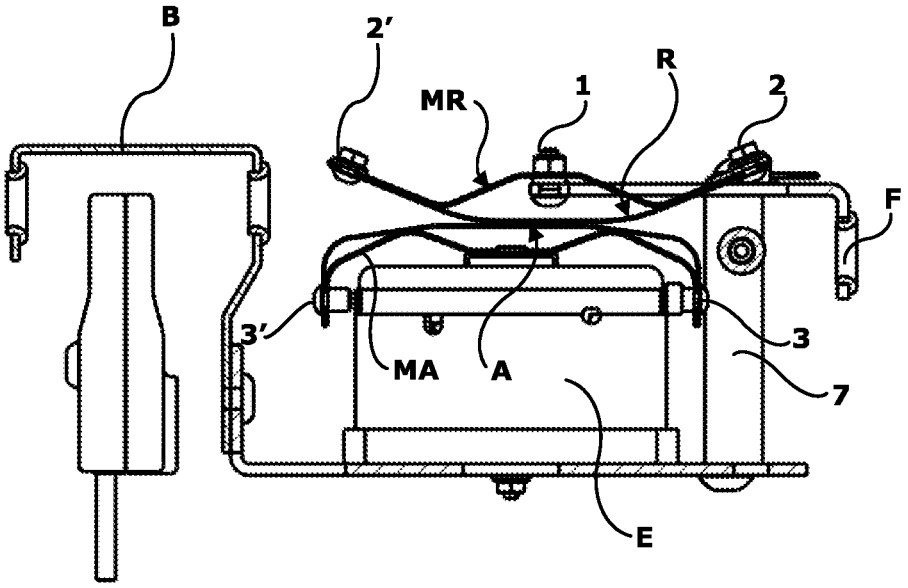
FIG. 4 is a partially cross-sectional view of the electromagnetic brake of FIG. 1, taken along line IV-IV of FIG. 3.
Figure 5:
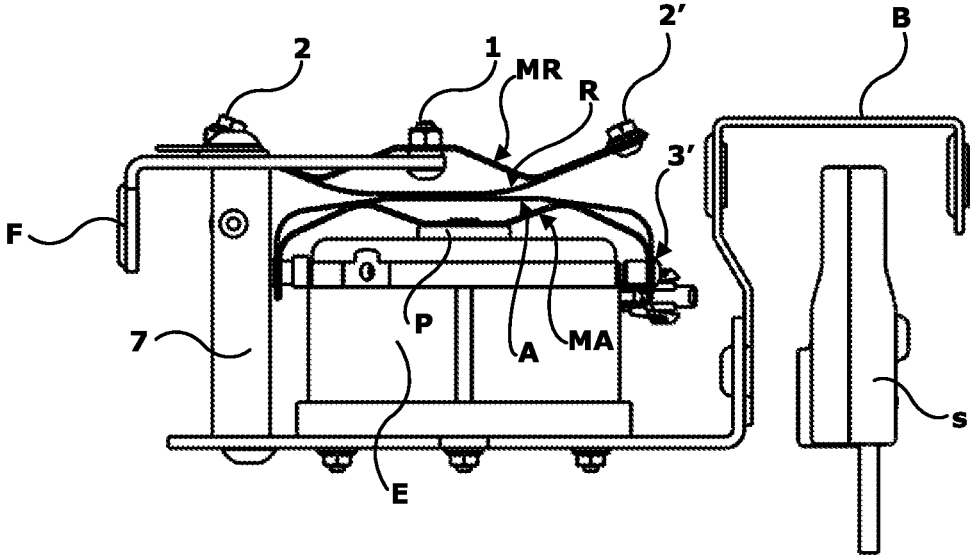
FIG. 5 is a side view of the electromagnetic brake of FIG. 1.

It should be immediately pointed out here that the opening movement between the two thin plates, caused by the alternative and consecutive oscillation of both of them, does not lead to any reduction or interruption of the braking action on the weft thread, which in fact goes on unchanged in a zone downstream of the entering node or upstream of the exiting node, where the two electromagnetic brake thin plates stay nevertheless always in contact. The arched shapes of the thin plates R and A, shown in particular in FIGS. 4 and 5, are designed so as to maintain a substantially constant braking action on the weft thread even when varying the relative rotation between the two plates.

As the knot goes more into between the two thin plates, the resistant thin plate R gradually recovers its standard inclination, while the operated thin plate A begins a similar and opposite oscillation to that of thin plate R, oscillation which is also delayed in time and shifted in space due to the offset of the respective fulcrums. After the knot is passed at the pivoting point 1 of the resistant thin plate R, this one starts to oscillate in the opposite direction thereby so quickly releasing the knot, while the braking action in this phase moves—after a short passage on the knot itself—onto the portions of the thin plates which are upstream of the position of the knot, symmetrically to what was described for the knot entry phase. Finally, also the operated thin plate A oscillates in the opposite direction, in a position where the knot has now no longer contact with the resistant thin plate R. The brake geometry thus recovers its initial undisturbed situation.

Obviously the described mechanism could, in a similar way, provide for making the entering knot meet the operated thin plate A first, and the resistant one R afterwards, interchanging the mutual position of the respective fulcrums, moved forward or backward by a set length with respect to the operating piston P axis that determines the central point of contact of the operated thin plate A. In both cases, and thanks to this arrangement, when a weft thread knot is located at one of the thin plates oscillation fulcrums, i.e. where the concerned thin plate is not able to offer any oscillation and would than require its translation in order to allow the passage of the knot, the opposite thin plate on the contrary is in contact with the knot in a still fairly distant location from its fulcrum so as to offer sufficient oscillation to allow the passage of the knot without causing the translation of the thin plate and therefore without causing increases of the weft thread tension beyond normal braking values.

According to a third feature of the invention, finally, it is provided that the oscillations induced in the thin plates by the passage of a knot are quickly damped to promptly bring the thin plates back into their standard working position before a new knot comes. A possible solution for a damping device to be applied to the electromagnetic brake of the present invention is made by a simple strip 5 of elastomeric material, having appropriate elasticity, which connects the free end 2 of the resistant thin plate R with two fixed anchorage points 4 provided at the top of the vertical fork 7, on opposite sides with respect to the free end 2 of the resistant thin plate R. Thanks to this simple device, as soon as the knot has left the resistant thin plate R, the oscillations of this latter are quickly damped by the strip 5, causing its stopping in the standard working position. The intimate and continuous contact between the two thin plates carries the damping action also onto the movement of the operated thin plate A mounted on the operating piston P. Obviously, also in this case the damping action could be implemented on the operated thin plate A and be transferred to the other one by simple contact, then with a reverse arrangement in respect to the one illustrated in the drawings, said arrangement having however the same functionality.

From the above description it is evident that the electromagnetic brake according to the present invention has fully reached the intended objects. In fact, thanks to the particular structure and arrangement of the resistant thin plate R and the operated thin plate A it is possible to obtain the passage of the weft thread knots through the electromagnetic brake without causing too a high rise of tension on the weft thread and without interrupting the braking effect on the same in any way.

Furthermore, as it is clear from the attached drawings, the new special structure and arrangement of the electromagnetic brake thin plates according to the present invention involve only a very moderate increase in the longitudinal electromagnetic brake bulk, which bulk increase substantially correspond to the existing offset between the resistant thin plate R fulcrum 1 and the operating piston P axis on whose head the operated thin plate A is pivoted. The device overall size is thus substantially the same of that of the known type electromagnetic brakes. Moreover and contrary to what happens in the above mentioned Picanol patent, the weft thread comes into contact with the thin plates A and R always in a single point, which changes position as the system geometry varies, whose evolution at the knot passage has been described above, but that always involves only a limited area of the weft thread; there is then no additional abrasive action on the weft thread compared to the traditional type electromagnetic brakes. Also the third object of the present invention is thus fully achieved.

It is anyhow understood that the invention is not to be considered limited to the particular arrangement illustrated above which only represents an exemplifying embodiment, but that different variants are possible, all within the reach of a skilled man in the art, without falling outside the scope of the invention itself, which is solely defined by the following claims.

The invention claimed is:

1. A piloted electromagnetic brake for controlling tension of weft threads in weaving machines, comprising:

a pair of opposite elastic thin plates, between which in operation a weft thread runs, a first of said pair of thin plates being an operated thin plate (A) which is adjustable into position by an electromagnetically controlled operating piston (P), and a second of said pair of thin plates being a resisting thin plate (R) which is resistant in reply to elastic contrast element, in order to control an intensity of a contrast force between said pair of thin plates, wherein at least one of said resisting thin plate (R) and said operated thin plate (A) has a fulcrum point in correspondence with a central portion thereof so as to freely oscillate in a plane containing the weft thread during passage of a weft thread knot between said resisting thin plate (R) and said operated thin plate (A).

2. The piloted electromagnetic brake as in claim 1, wherein said fulcrum point of at least one of said resisting thin plate (R) and said operated thin plate (A) is offset, backward or forward, by a set length along a running direction of the weft thread with respect to a central point of contact or to the fulcrum point of the other one of said resisting thin plate (R) and said operated thin plate (A).

3. The piloted electromagnetic brake as in claim 1, wherein said resisting thin plate (R) is joined to a first laminar spring element (MR) and elastically supported by said first spring element (MR), a fulcrum point (1) of said resisting thin plate (R) being located in said first spring element (MR).

4. The piloted electromagnetic brake as in claim 3, wherein said fulcrum point (1) of the resisting thin plate (R) in the first spring element (MR) is constrained to a hollow triangular bracket (6) projecting from a vertical support fork (7), integral with the electromagnetic brake frame.

5. The piloted electromagnetic brake as in claim 3, wherein said resisting thin plate (R) has an arched shape.

6. The piloted electromagnetic brake as in claim 3, wherein said fulcrum point (1) of the resisting thin plate (R) is offset, backward or forward, by a set length with respect to an axis of the operating piston (P) which determines a central point of contact of the operated thin plate (A).

7. The piloted electromagnetic brake as in claim 6, wherein said operated thin plate (A) is joined to a second spring element (MA) and elastically supported by said second spring element (MA), a fulcrum point of said operated thin plate (A) being located in said second spring element (MA).

8. The piloted electromagnetic brake as in claim 7, wherein said fulcrum point of the operated thin plate (A) in the second spring element (MA) is constrained to a head of the operating piston (P).

9. The piloted electromagnetic brake as in claim 8, wherein ends of the operated thin plate (A) and of the second spring element (MA) are connected to an electromagnet (E) body by a bond to prevent a rotation of the operated thin plate (A) around the axis of the operating piston (P) while allowing an oscillating movement of the operated thin plate in a plane containing the weft thread and the ends (3, 3') of the operated thin plate (A).

10. The piloted electromagnetic brake as in claim 4, furthermore comprising:

a damping device for dampening of the oscillations of at least one of said resisting thin plate (R) and said operated thin plate (A).

11. The piloted electromagnetic brake as in claim 10, wherein said damping device consists of a strip (5) of elastomeric material which connects a free end (2) of the resisting thin plate (R) to two anchorage points (4) provided at a top of the vertical support fork (7), on opposite sides of said free end (2) of the resisting thin plate (R).

12. The piloted electromagnetic brake as in claim 2, wherein said resisting thin plate (R) is joined to a first laminar spring element (MR) and elastically supported by said first spring element (MR), a fulcrum point (1) of said resisting thin plate (R) being located in said first spring element (MR).

13. The piloted electromagnetic brake as in claim 7, furthermore comprising:

a damping device for dampening of the oscillations of at least one of said resisting thin plate (R) and said operated thin plate (A).

14. The piloted electromagnetic brake as in claim 8, furthermore comprising:

a damping device for dampening of the oscillations of at least one of said resisting thin plate (R) and said operated thin plate (A).

15. The piloted electromagnetic brake as in claim 9, furthermore comprising:

a damping device for dampening of the oscillations of at least one of said resisting thin plate (R) and said operated thin plate (A).

* * * * *